US005869781A

United States Patent [19]

Kurata

[11] Patent Number: 5,869,781

[45] Date of Patent: Feb. 9, 1999

[54] TONE SIGNAL GENERATOR HAVING A SOUND EFFECT FUNCTION

[75] Inventor: Mitsuhiro Kurata, Hamamatsu, Japan

[73] Assignee: Yamaha Corporation, Hamamatsu, Japan

[21] Appl. No.: 840,898

[22] Filed: Apr. 17, 1997

Related U.S. Application Data

[63] Continuation of Ser. No. 414,193, Mar. 31, 1995, abandoned.

[30] Foreign Application Priority Data

| | | | |
|---|---|---|---|
| Mar. 31, 1994 | [JP] | Japan | 6-062560 |
| Mar. 31, 1994 | [JP] | Japan | 6-062563 |
| Mar. 31, 1994 | [JP] | Japan | 6-062566 |

[51] Int. Cl.[6] ..... G10H 1/057; G10H 1/06; G10H 7/02

[52] U.S. Cl. ..... 84/603; 84/604; 84/617; 84/624; 84/627

[58] Field of Search ..... 84/600, 603–614, 84/622–633, 662–665, 464 R, 464 A, DIG. 10

[56] References Cited

U.S. PATENT DOCUMENTS

| | | | |
|---|---|---|---|
| Re. 31,648 | 8/1984 | Kondo et al. | 84/605 |
| Re. 33,738 | 11/1991 | Okumura | 84/605 |
| 3,908,504 | 9/1975 | Deutsch | 84/623 |
| 3,913,442 | 10/1975 | Deutsch | 84/623 |
| 3,951,030 | 4/1976 | Deutsch | 84/629 |
| 4,215,619 | 8/1980 | Budelman et al. | 84/609 |
| 4,249,447 | 2/1981 | Tomisawa | 84/605 |
| 4,287,805 | 9/1981 | Gross | 84/627 |
| 4,294,153 | 10/1981 | Mitsuhashi | 84/624 X |
| 4,419,919 | 12/1983 | Kashio | 84/627 |
| 4,485,717 | 12/1984 | Kitagawa | 84/608 |
| 4,628,789 | 12/1986 | Fujimori | 84/626 |
| 4,643,066 | 2/1987 | Oya | 84/627 X |
| 4,655,114 | 4/1987 | Sunada | 84/626 |
| 4,655,115 | 4/1987 | Nishimoto | 84/624 |
| 4,677,890 | 7/1987 | Yannes | 84/663 X |
| 4,713,997 | 12/1987 | Deutsch | 84/605 |
| 4,753,148 | 6/1988 | Johnson | 84/464 R |
| 4,813,326 | 3/1989 | Hirano et al. | 84/624 |
| 4,920,851 | 5/1990 | Abe | 84/626 |
| 5,025,700 | 6/1991 | Morikawa et al. | 84/603 |
| 5,131,042 | 7/1992 | Oda | 84/605 X |
| 5,144,096 | 9/1992 | Kunimoto | 84/630 X |
| 5,155,286 | 10/1992 | Saito et al. | 84/611 |
| 5,198,604 | 3/1993 | Higashi et al. | 84/626 |
| 5,200,564 | 4/1993 | Usami et al. | 84/627 |
| 5,218,156 | 6/1993 | Iizuka et al. | 84/DIG. 10 |
| 5,243,124 | 9/1993 | Kondratiuk et al. | 84/629 X |
| 5,254,805 | 10/1993 | Iizuka | 84/626 |
| 5,278,346 | 1/1994 | Yamaguchi et al. | 84/609 |
| 5,354,948 | 10/1994 | Toda | 84/626 X |
| 5,357,045 | 10/1994 | Tabei | 84/627 X |
| 5,367,118 | 11/1994 | Iwaooji | 84/604 |
| 5,410,603 | 4/1995 | Ishiguro et al. | 84/626 X |
| 5,412,152 | 5/1995 | Kageyama et al. | 84/607 |
| 5,434,348 | 7/1995 | Matsuda et al. | 84/626 X |
| 5,471,009 | 11/1995 | Oba et al. | 84/600 X |
| 5,473,107 | 12/1995 | Mizuno | 84/626 X |
| 5,478,968 | 12/1995 | Kitagawa et al. | 84/626 |
| 5,508,469 | 4/1996 | Kunimoto et al. | 84/603 |
| 5,522,010 | 5/1996 | Toyama | 84/604 X |
| 5,536,902 | 7/1996 | Serra et al. | 84/627 X |

OTHER PUBLICATIONS

Watkinson, John; The Art of Digital Audio, Chapter 4: Advanced digital audio processing; Focal Press, 1989.

*Primary Examiner*—Stanley J. Witkowski
*Attorney, Agent, or Firm*—Pillsbury Madison & Sutro LLP

[57] ABSTRACT

A tone signal generator includes a tone signal data generating device, a signal data generating device, and a sound effects imparting device, such as a digital signal processor. The sound effects are imparted to the tone signal data based on the signal data in such a way that the digital signal processor processes the tone signal data and the signal data by repeatedly multiplying and adding them. In the process, a signal data supplying device supplies the tone signal data to the signal data generating device so that the tone signal data is used in place of the signal data. The digital signal processor processes the first tone signal data generated by the tone signal generating device and the second tone signal device supplied by the signal data supplying device so that the sound effects are imparted to the first tone signal data based on the second tone signal data.

18 Claims, 16 Drawing Sheets

DSP CIRCUIT

DRAM INTERNAL CONSTITUTION

DRAM INTERNAL CONSTITUTION

TONE SIGNAL GENERATOR HAVING A SOUND EFFECT FUNCTION

This is a continuation of application Ser. No. 08/414,193, filed Mar. 31, 1995, now abandoned.

BACKGROUND OF THE INVENTION

1. Field of the Invention

The present invention relates to a tone signal generator which can generate tone signals to which various specialized sound effects such as modulation and pitch change are provided, along with musical tones and normal sound effects.

2. Description of the Prior Art

TV game instruments for entertainment in practical use have a tone signal generator. In this instrument, data of tone signals stored in a game cartridge provided by a ROM or a CD-ROM is supplied into an internal RAM of the game instrument, and the data is read according to progress of a game program carried out for generating musical tones with the normal sound effects and the musical tones as back ground music.

The above musical tones for the TV game instruments or the like involve various specialized sound effects, such as modulation, for entertainment of the game. In order to obtain advantages of the sound effects, some coefficients supplied to the tone signal generator are required. The coefficients are used for deciding a level of the sound effects and drifting the level thereof.

The prior tone signal generators have been provided with LFOs (Low Frequency Oscillators) and modulation signal generation circuits used for only generating the coefficients.

Generally, a DSP (digital Signal Processor) chip is used to generate the sound effects. In the DSP, it is necessary to prepare signal data to be parameters for filtering and modulating. For example, in case of modulating, the signal data for the modulating is required. Therefore, the prior tone signal generators have been provided with a circuit which has many functions to generate various kinds of the signal data.

Furthermore, it is possible to prepare a plurality of groups of coefficients in advance for filtering, and to change the present group dynamically to allow the tone signal generator to generate various sound effects. Therefore, the prior tone signal generators are provided with a filter device using a DSP chip schematically shown in FIG. 18.

In FIG. 18, a plurality of filter coefficients (a to d) are supplied from a filter coefficient register R to a DSP 71, and the DSP 71 uses a set of the coefficients for filtering to a filter input signal Si in one sample process time. In dynamically changing the filter coefficients, a CPU 70 changes the coefficients stored in the coefficient register R with time. In this case, writing the coefficients from the CPU 70 to the coefficient register R is performed successively in time series according to a process clock of the CPU 70. Therefore, a certain extent of time is required to replace the present set of the coefficients in the coefficients register R with a new set of the coefficients.

The prior tone signal generators, however, have disadvantages in that they need discrete hard circuits, such as the LFO and the modulation signal generation circuit, resulting in complex constitution of a whole circuit, large-sized LSI, and cost-up. Still more, it is difficult to obtain complex sound effects. Therefore, there is a limitation of the sound effects in each game program.

Furthermore, the prior tone signal generators having a circuit for the functions of generating various kinds of the signal data have another disadvantage in that the whole circuit becomes more complex, larger and more expensive.

Still more, in the filter configuration of the prior tone signal generator, re-writing of the coefficients causes conflicts of the filtering process. For instance, if the group of coefficients a–d is changed to the group of coefficients e–h in the coefficient register R, the coefficients of the two groups are mixed till the whole coefficients changing is finished. This mixed state makes the DSP wrong filtering process, therefore causing noises into a filter output signal So and oscillations of the DSP.

SUMMARY OF THE INVENTION

It is therefore an object of the present invention to provide a tone signal generator which is capable of minimizing the circuit for generating the musical tone with sound effects.

It is another object of the present invention to provide a tone signal generator which is capable of changing easy the level and the kind of the sound effects.

It is yet another object of the present invention to provide a tone signal generator which is capable of generating various kinds of signal data for filtering and modulating.

It is further object of the present invention to provide a tone signal generator which is capable of changing the coefficients of filtering in time series without conflicts.

In accordance with of the present invention, an embodiment of the tone signal generator includes tone signal data generating means for generating tone signal data, signal data generating means for generating signal data, and sound effect imparting means for imparting sound effects to the tone signal data generated by the tone signal data generating means, based on the signal data generated by the signal data generating means.

The tone signal generating means and the signal data generating means include a memory for storing pulse code modulation data consisting of a plurality of the tone signal data and the signal data. The sound effect imparting means processes the sound effects imparting to the tone signal data stored in the memory based on the signal data stored in the memory. The tone signal generator further includes signal data supplying means for supplying the tone signal data to the signal data generating means as the signal data to be generated. By the performing of the signal data supplying means, the tone signal data is inputted to the sound effect imparting means in place of the signal data, thus inputted tone signal data being used for imparting the sound effects to another tone signal data generated by the tone signal data generating means.

Another embodiment of the tone signal generator includes fix means for fixing the tone signal data to fixed data or outputting the tone signal data as it is, and the envelope imparting means for generating envelope imparted signal data by modulating output data from the fix means with envelope data or low frequency signal data. The sound effects impart means imparts the sound effects to the tone signal data based on the envelope imparted signal data generated by the envelope imparting means. If the fixed data is "1", the envelope imparted signal data is equal to the envelope data or the low frequency signal data, thereby, the envelope data or the low frequency signal data is supplied to the sound effects impart means as it is.

Another embodiment of the tone signal generator includes a bit inverter for generating inverted data by inverting the sign bit and/or the amplitude data bits of the signal data. The signal data is sin curve wave data or saw tooth wave data. The signal data is changed by inverting the sign bit and/or the amplitude bits, thus obtained signal data being used for filtering or modulating in the sound effect imparting means.

Further embodiment of the tone signal generator includes coefficient table means for storing a plurality of coefficient data, and coefficient address specifying means for specifying a plurality of coefficient addresses in the coefficient table means at the same time. The coefficients for filtering or modulating are supplied to the sound effect imparting means. If a way of the filtering or the modulating is changed, the plurality of coefficient addresses are changed by the coefficient address specifying means, therefore, the plurality of coefficient data being changed at the same time to thereby avoid conflicts of the coefficients.

DETAILED DESCRIPTION OF THE PREFERRED EMBODIMENT

Figure 1:
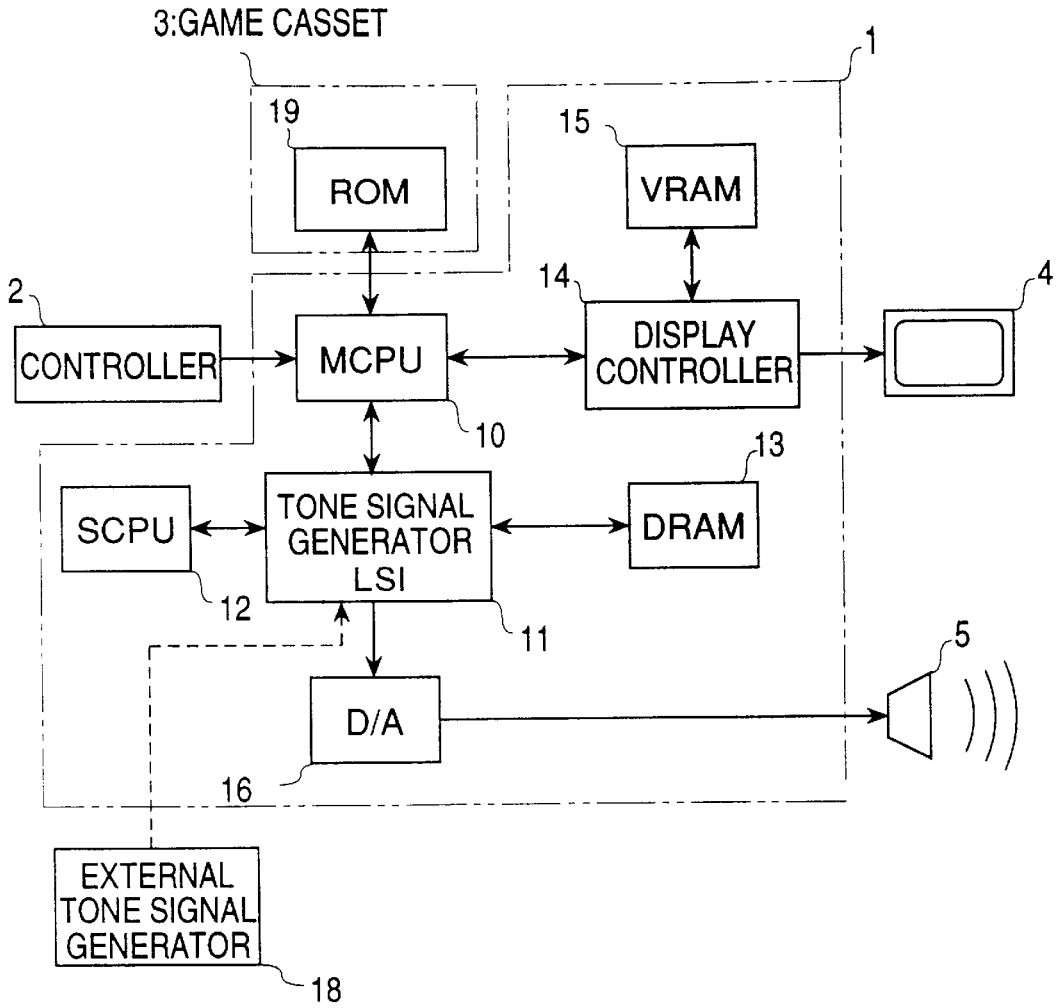
FIG. 1 is a block diagram of a TV game instrument, to which a tone signal generator LSI is applied, embodying the present invention.

FIG. 1 is a block diagram of a TV game instrument, to which a tone signal generator LSI is applied, embodying the present invention.

A display 4 and a speaker 5 are connected to a game instrument 1. The display 4 and the speaker 5 can be used as ones installed into a normal TV receiver. To the game instrument 1, a game cartridge 3 having a ROM 19 in which a game program is stored and a controller 2 for a player to play a game are also connected. The controller 2 is connected to the game instrument 1 through a cable or the like, and the game cartridge 3 is set into a slot mounted in the game instrument 1.

The game instrument 1 is equipped with a main CPU (MCPU) 10 which controls a whole program of the game progress. To the MCPU 10, the controller 2, the ROM 19 mounted into the game cartridge 3, a display controller 14 for controlling the display 4 and a tone signal generator LSI 11, for generating tone signals, such as musical tone signals, with sound effects and musical tones as a back ground music, are connected. A sound CPU (SCPU) 12, a DRAM 13 in which a program for the SCPU 12 and PCM wave data are stored, and a D/A converter 16, for converting generated musical tone data into analogue musical tone signals, are connected to the tone signal generator LSI 11. The speaker 5 is connected to the D/A converter 16. The tone signal generator LSI 11 is provided with an external input terminal into which digital tone data can be inputted from an external tone signal generator 18. A VRAM 15 in which screen display data is stored and the display 4 are connected to the display controller 14.

When the power turns on after the game cartridge 3 is set into the game instrument, the MCPU 10 reads specified screen data and sends it to the display controller 14. Then, the MCPU 10 writes programs and the PCM wave data in the DRAM 13, for generating the tone signal data with the sound effects and the BGM (Back Ground Music) tone signal data. After that, the game program is started by operation of the controller 2, and the re-writing of the screen data and the generating of the tone signal data with the sound effects and the BGM tone signal data are performed. The progress control of the game program, i.e., re-writing of the screen data, is carried out directly by the MCPU 10. The MCPU 10 gives instructions to the SCPU 12 for generating the tone signal data with the sound effects and the BGM tone signal data, and the synthesizing of the real tone signal is carried out by the SCPU 12 on the basis of the program and the PCM wave data written into the DRAM 13.

Figure 2:
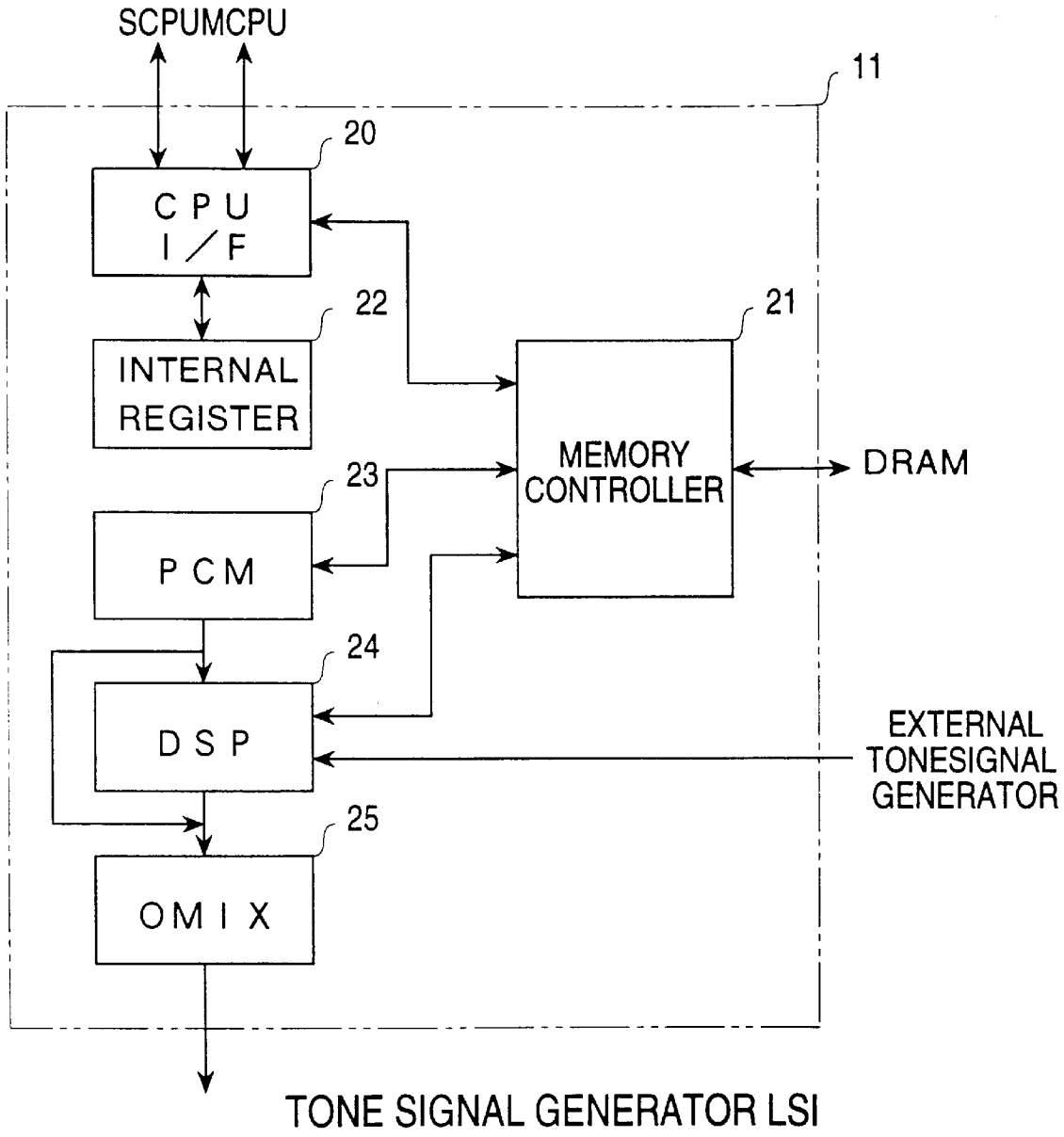
FIG. 2 is a block diagram of the tone signal generator LSI.

FIG. 2 is an internal block diagram of the tone signal generator LSI 11. In the tone signal generator LSI 11, a PCM circuit 23 generates digital low frequency signal data, such as the tone signal data and modulation signal data, when it reads the PCM wave data stored in the DRAM 13 (refer to FIG. 1). As described above, when the game cartridge 3 is set into the slot and the power is turned on, data is streamed from the ROM 19 to the DRAM 13. Therefore, the tone signal data with the sound effects and the BGM tone signal data can be individually different in each game program. To the DRAM 13, the MCPU 10 and the SCPU 12 are connected through a memory controller 21 and a CPU interface 20, and the PCM circuit 23 and a DSP (digital signal processor) 24 mounted into the tone signal generator LSI 11 are connected through the memory controller 21. The MCPU 10, the SCPU 12, the PCM circuit 23 and the DSP 24 are individually accessible to the DRAM 13 by sharing time. An internal register 22 is connected to the CPU interface 20. Data set into the PCM circuit 23 and the DSP 24, and data for specifying data to set into them by the MCPU 10 and the SCPU 11 are temporarily stored into the internal register 22.

Figure 5:
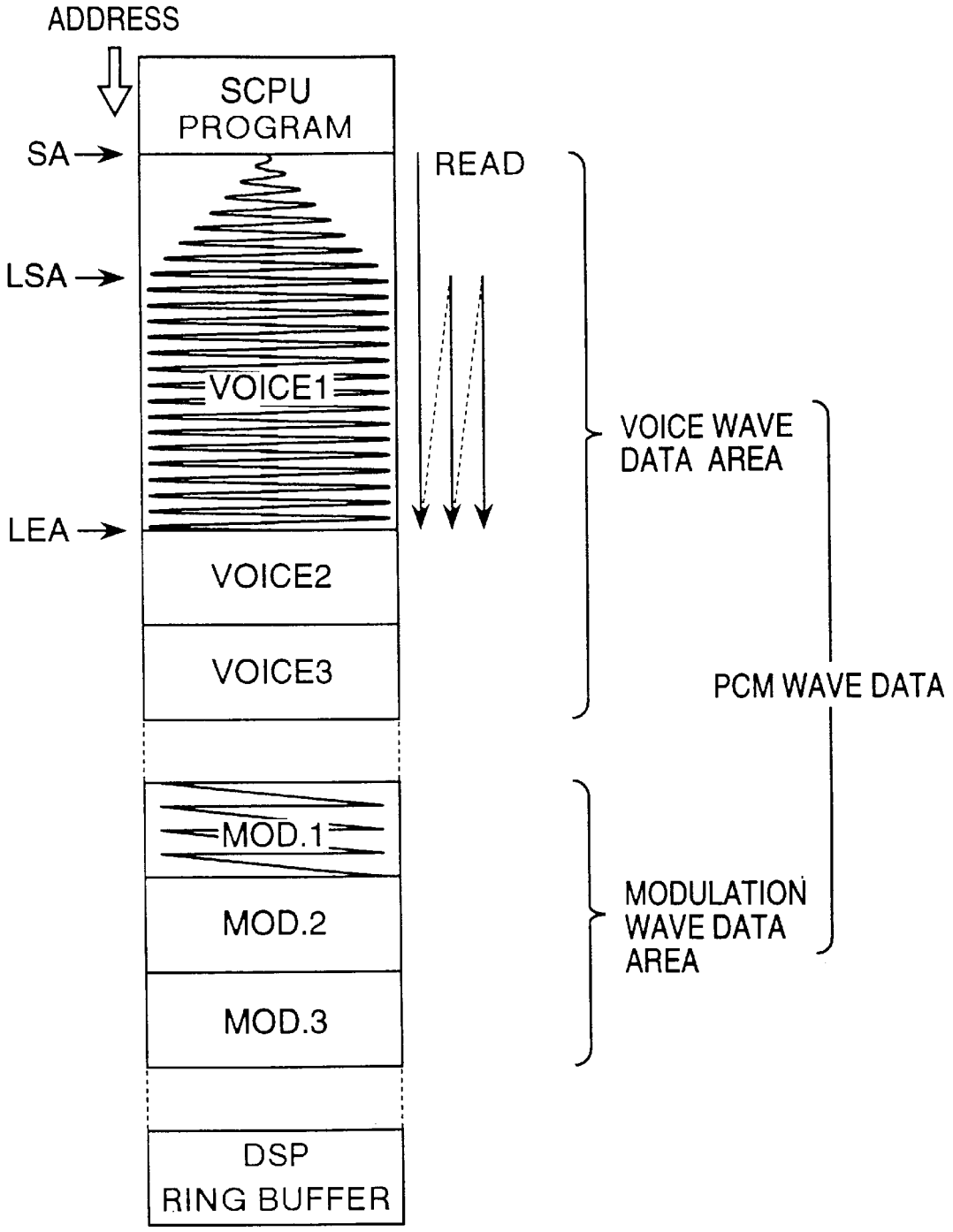
FIG. 5 illustrates an internal configuration of a DRAM connected to the tone signal generator LSI.

FIG. 5 shows an internal configuration of the DRAM 13.

In the DRAM 13, a SCPU program area for the SCPU 12, a PCM wave data area and a DSP ring buffer are assigned.

The PCM wave data includes voice wave data to generate musical tone signals with the sound effects and the BGM tones, and the modulation wave data used as parameters for the sound effects such as the modulation. The plural kinds of voice wave data and the modulation wave data exist and are stored for each data in the DRAM 13. The DSP ring buffer area is used to delay the tone signal data to thereby effect the filtering and the modulating or the like in the DSP 24's process.

As the voice wave data, sampled data of the tone signals with the sound effects or of natural instrument's tone signals is used generally. Such tone signals keep generating tones in long time, so that the voice wave data comprises the start address data SA, and the loop start address data LSA and the loop end address data LEA to read repeatedly. First, the SA is read, and then LSA, LEA are read successively and repeatedly. As a result, the repeated reading between the LSA and the LEA allows generating tone signals to be long time. The modulation wave data is generally simple data, such as sin curve wave data or wave data shown in FIG. 7 (FIGS. 7A to 7D, because it is for modulating musical tone signals or the like.

The SCPU program, the voice wave data and the modulation data are written by the MCPU 10 when the game cartridge 3 is set into the slot. The SCPU 12 processes the SCPU program based on the MCPU 10's instructions. The PCM circuit 23 reads the PCM wave data based on the SCPU 12's instructions, and generates the digital low frequency signal data. The digital low frequency signal data is used as the tone signal data or the sound effect data. The PCM circuit 23 has thirty two time sharing channels in which thirty two kinds of the digital low frequency signal data can be generated individually.

The tone signal data in the digital low frequency signal data that the PCM circuit 23 generates is inputted into the DSP 24 or inputted directly into an out mixing circuit OMIX 25. The modulation signal data is inputted into the DSP 24 for coefficients of the sound effects. Usually, the reading data of the voice wave data area is used as the tone signal data, and the reading data of the modulation wave data area is used as the modulation signal data. However, how to use the signal data is free to thereby generate any desired sound effects. For example, it is possible to use the reading data of the voice wave data area as the modulation signal data. Furthermore, the DSP 24 has an outer external terminal into which other tone signal data or other modulation signal data can be inputted.

The DSP 24 is a circuit for supplying various sound effects, such as modulating, filtering and pitch-changing, to the inputted tone signal data and outputting thus obtained data to the output mixing circuit OMIX 25. In order to supply the sound effects to the tone signal data, the modulation signal data which is one of the digital low frequency signal data is inputted into the DSP 24, and the DSP 24 uses the modulation signal data as the coefficients for supplying the sound effects. The tone signal data to which the sound effects is supplied by the DSP 24 is inputted into the output mixing circuit OMIX 25. The OMIX circuit 25 changes each tone signal data in the thirty two channels to stereo signal data in two channels, and outputs the stereo signal data to the D/A converter circuit 16.

Figure 3:
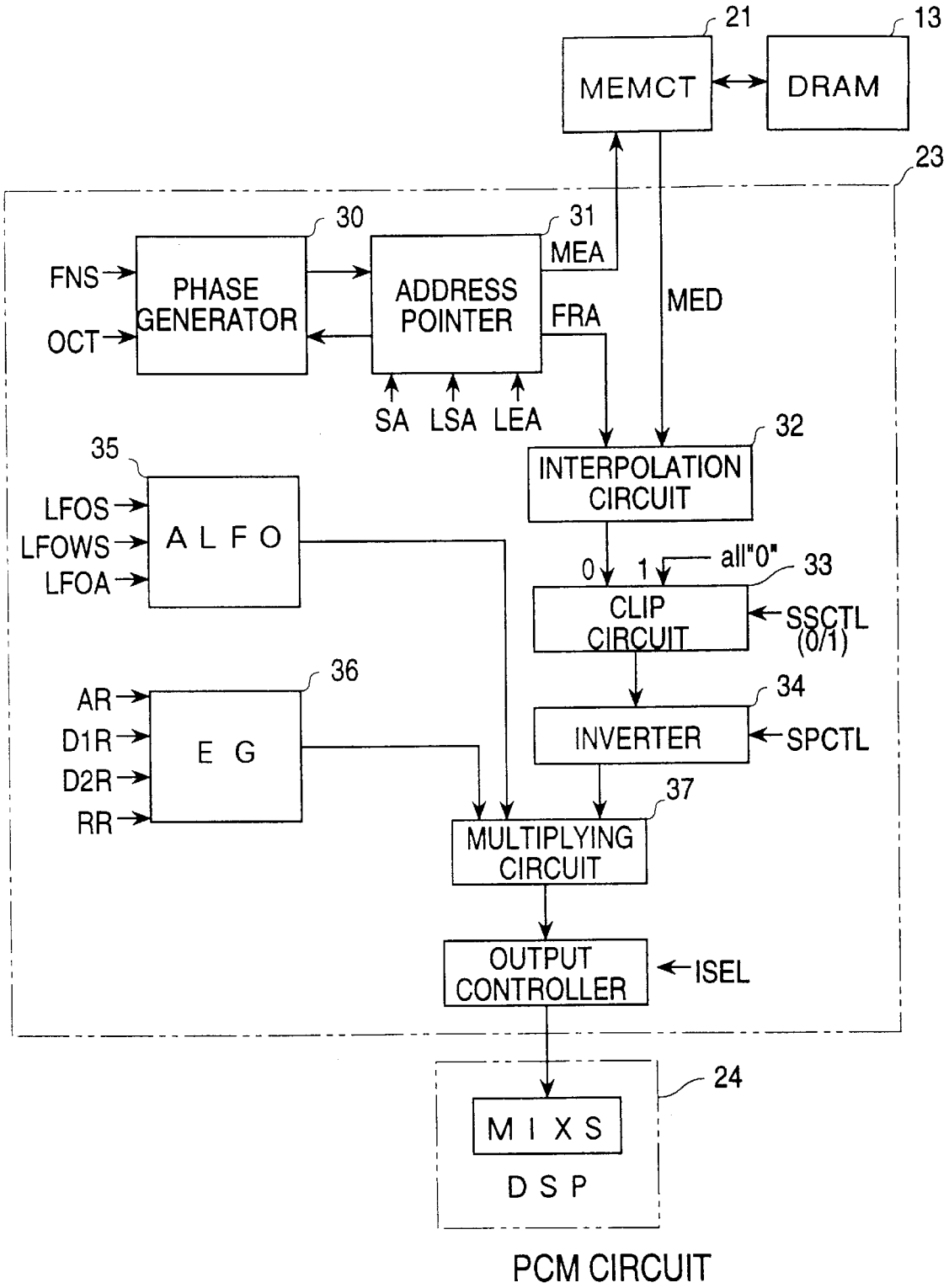
FIG. 3 is a block diagram of a PCM circuit in the tone signal generator LSI.

FIG. 3 shows an internal configuration of the PCM circuit 23.

The PCM circuit 23 comprises a phrase generator 30, an address pointer 31, an interpolation circuit 32, a clip circuit 33, an inverter 34, a low frequency wave generator for amplitude modulation (ALFO) 35, an envelope generator 36, a multiplying circuit 37 and an output controller 38. The process in the PCM circuit is carried out by the time-shared way of the thirty two channels.

FNS data, frequency specifying data in an octave, which is corresponding to a tone pitch name and octave data OCT are supplied from the SCPU 12, and the data is set into the phrase generator 30. The phrase generator 30 generates phrase data based on the FNS and the OCT for each specified sampling cycle. The phrase data is inputted into the address pointer 31. The start address data SA, the loop start address data LSA and the loop end address data LEA, which specify a set of PCM wave data, are inputted into the address pointer 31 from the SCPU 12. The address pointer 31 decides an incremental amount of an address number according to the phrase data inputted from the phrase generator 30, and outputs the address data including a decimal fraction. The decimal fraction data FRA is outputted to the interpolation circuit 32, and two integer addresses MEA between which the FRA is sandwiched are outputted to the DRAM 13 through the memory controller 21.

The first PCM wave data and the second PCM wave data which is next to the first PCM wave data are read from the DRAM 13 according to the two inputted integer addresses MEA. The PCM wave data read from the DRAM 13 is inputted into the interpolation circuit 32 through the memory controller 21. The interpolation circuit 32 interpolates the two inputted PCM wave data according to the FRA inputted from the address pointer 31, and generates the digital low frequency signal data. The interpolation circuit 32 outputs thus obtained data to the clip circuit 33. The clip circuit 33 is a selector which change the output between the digital low frequency signal data inputted from the interpolation circuit 32 and all "0" data, selecting either for the output according to select signal data SSCTL inputted from the SCPU 12. If the SSCTL is "0", the digital low frequency signal data inputted from the interpolation circuit 32 is outputted as it is to the inverter 34. If the SSCTL is "1", the all "0" data is outputted to the inverter 34 in place of the digital low frequency signal data.

Figure 6:
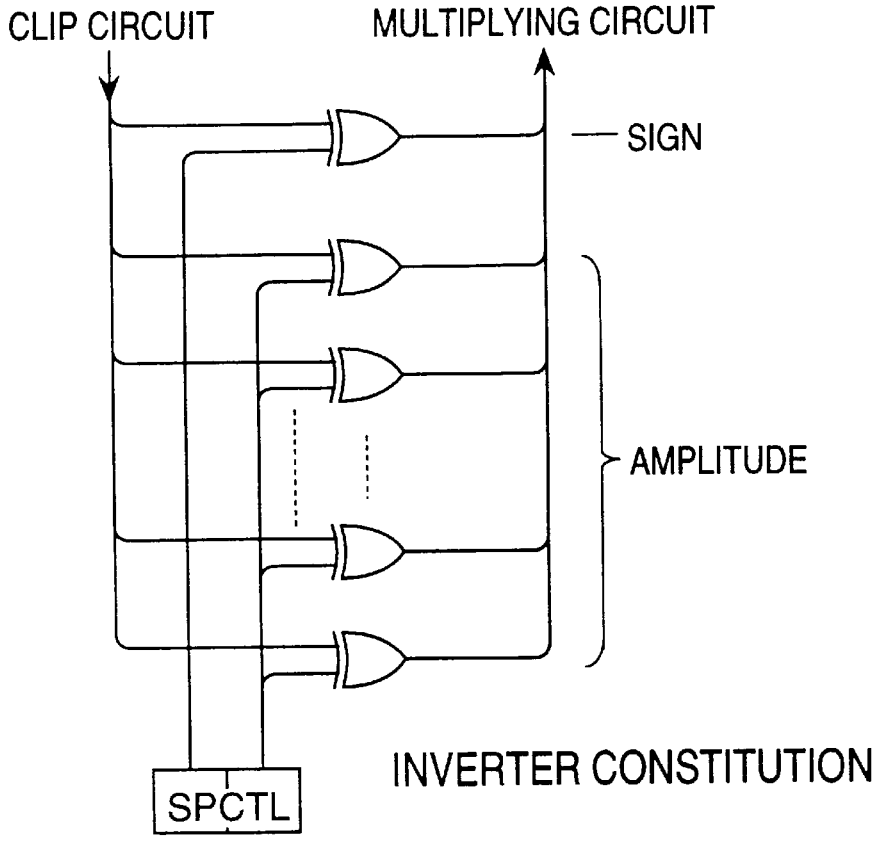
FIG. 6 illustrates a configuration of an inverter in the PCM circuit constituted in the tone signal generator LSI.
Figure 7A:
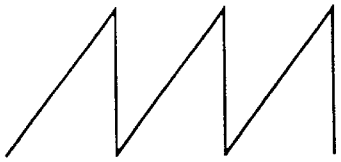
FIGS. 7A to 7D show examples of a modulation wave stored in the DRAM.
Figure 7C:
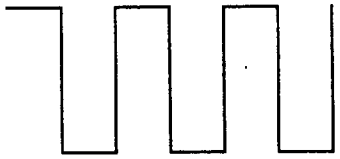
Figure 7B:
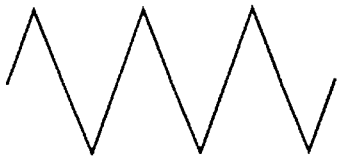
Figure 7D:
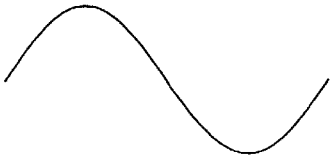

The digital low frequency signal data consists of plural bits data (for example, 16 bits data). The inverter 34 consists of exclusive OR circuits (XORs) as shown in FIG. 6. The XORs invert the inputted signal data when each of SPCTL data is "1". The SPCTL data, 2 bits data, is outputted from the SCPU 12. To the two input terminals of the XORs, the digital low frequency signal data and the SPCTL data are inputted. One side of the XORs to which the sign bit (the highest bit) of the digital low frequency signal data and a higher bit of the SPCTL data are supplied is used as a sign bit inverter. The other XORs to which the amplitude data bits and a lower bit of the SPCTL data are supplied are used as amplitude bit inverters. Therefore, if the SPCTL's two bits data consists of "0" and "0", the inputted digital low frequency signal data is outputted as it is. If the SPCTL's two bits data consists of "1" and "0", only the sign data of the inputted digital low frequency signal data is inverted. If the SPCTL's two bits data consists of "0" and "1", the numeric part (amplitude signal part) of the digital low frequency signal data is inverted, and if the data consists of "1" and "1", all the inputted digital low frequency signal data is inverted.

Therefore, if the SSCTL is set to "1", all "0" data is outputted from the clip circuit 33, and the all "0" data is inputted into the inverter 34. In this state, if the SPCTL is set to "0" and "1", all "0", data is inverted by the inverter 34, causing generating data of "01111 . . . 1" (MAX). This data is used as the multiplying data in the multiplying circuit 37, which is located in latter stage of the PCM circuit 23, to output envelope wave data or modulation signal data as it is.

The digital low frequency signal data (it may include direct current signal data.) outputted from the inverter 34 is inputted into the multiplying circuit 37. The low frequency wave generator for amplitude modulation (ALFO) 35 and the envelope generator (EG) 36 are connected to the multiplying circuit 37. If normal musical tone signaldata is inputted into the multiplying circuit 37 as the digital low frequency signal data, amplitude modulating or providing of an envelope wave is performed by the multiplying circuit 37. If a programmer wants to directly use the low frequency wave signal data generated by the ALFO 35 or the envelope wave signal generated by the EG 36 at the DSP 24, as the modulation signal data, the digital low frequency signal data is fixed to a specified D. C. value and inputted into the multiplying circuit 37. As a result, the inputted data from the ALFO 35 or the EG 36 can be outputted directly from the multiplying circuit 37.

Therefore, if a programmer wants to directly output the wave data of the ALFO 35 or the EG 36 from the multiplying circuit 37, the SSCTL is set to "1" and the SPCTL is set to "0" and "1", for example. This results in that the output of the clip circuit 33 is fixed to "0, 0 . . . 0", and the output of the inverter 34 is fixed to the maximum value data "0,1 . . . 1". This fixed data is multiplied by the output data of the ALFO 35 or the output data of the EG 36, and therefore the output data of the ALFO 35 or the EG 36 is directly outputted from the multiplying circuit 37.

At the multiplying circuit, the following process is carried out.

If the musical tone signal data is inputted into the multiplying circuit 37 as the digital low frequency signal data, and the low frequency wave signal data is inputted from the ALFO 35 into the circuit 37, the inputted musical tone signal data is modulated by the low frequency wave signal data.

If the musical tone signal data is inputted into the multiplying circuit 37 as the digital low frequency signal data, and the envelope wave data is inputted from the EG 36 into the circuit 37, the inputted musical tone signal data is multiplied by the envelope wave data to provide the changing of the tone volume according to the envelope wave data.

If the low frequency signal data or the envelope wave data is used directly for the modulation at the DSP 24, the digital low frequency signal data is fixed (changed) to a specified value at the clip circuit 33, and the low frequency signal data or the envelope wave data is outputted directly from the multiplying circuit 37.

If the digital low frequency signal data is used as the modulation data for providing the tone signal data with the sound effects, the ALFO 35 and the EG 36 are substantially set to "OFF" to output the modulation data directly from the multiplying circuit 37.

Figure 8:
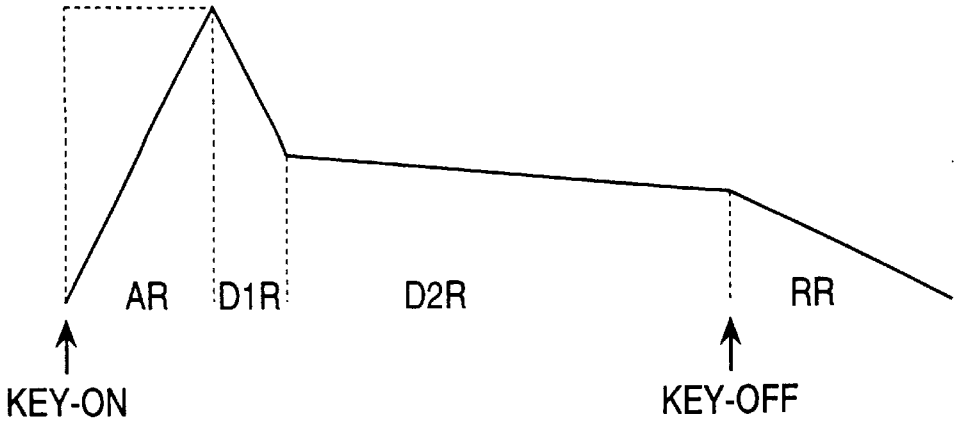
FIG. 8 shows an example of an envelope generated by the PCM circuit.

The ALFO 35 and the EG 36 are arranged by a well known circuit. The ALFO 35 generates the sin curve wave data or the low frequency wave data as shown in FIGS. 7A to 7D, for example, according to frequency data LFOS, wave specifying data LFOWS, and influence data (amplitude data) LFOA supplied by the SCPU 12. The EG 36 generates the envelope wave data as shown in FIG. 8, according to attack rate data AR, first decay rate data D1R, second decay rate data D2R, and release rate data RR supplied by the SCPU 12. The PCM wave data may include the wave data in which an envelope wave is provided to only an attack part, a part from the start address SA to the loop start address LSA. If such PCM wave data is read, the maximum value data is outputted from the EG 36 during the attack part reading (refer to the broken line in FIG. 8).

The output data from the multiplying circuit 37 is outputted to the DSP 24 or the output mixing circuit 25 through the output controller 38.

The low frequency signal data generated by the ALFO 35 or the modulation signal data read from the DRAM 13 can be inputted into the phrase generator 30 to drift the phrase for reading address. The phrase data so operated allows the digital low frequency signal data to be frequency-modulated.

Figure 4:
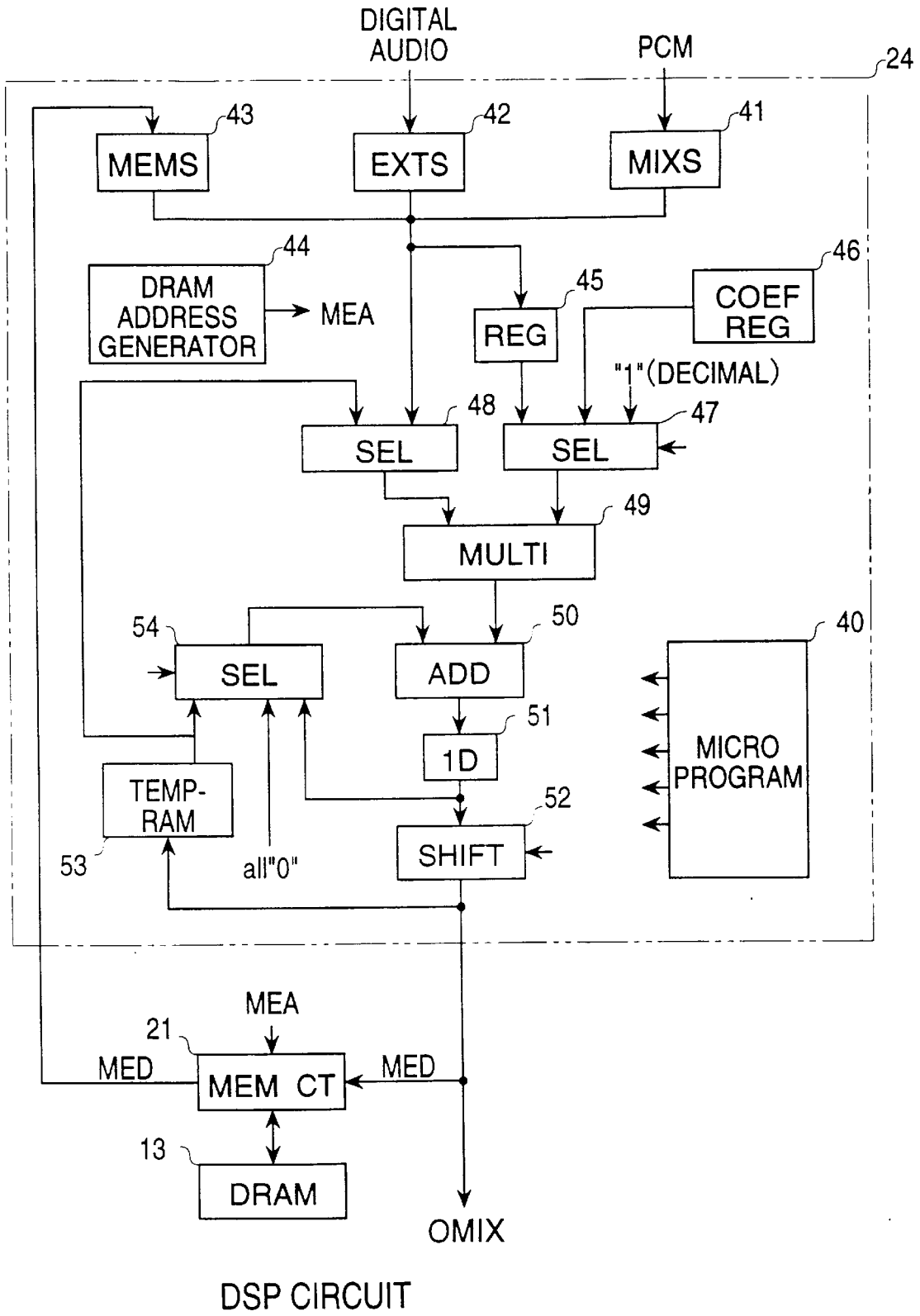
FIG. 4 is a block diagram of a DSP in the tone signal generator LSI.

FIG. 4 is a block diagram of the DSP 24 which is built into the tone signal generator LSI 11.

In the DSP 24, the digital low frequency signal data for the 16 channels inputted from the PCM circuit 23 can be handled at the same time, and also the digital low frequency signal data for the 2 channels inputted from outside can be handled at the same time. The DSP 24 processes the inputted data by delaying or filtering if the data is the tone signal data, and outputs thus processed data to the output mixing circuit 25. Furthermore, the DSP 24 can process the digital low frequency signal data as the modulation data, i. e., the coefficient data for providing the sound effects, to any tone signal data.

In this embodiment, the PCM circuit 23 has 32 channels while the DSP 24 has 16 channels. This difference in the number of channels may be cancelled by that a part of the output of the DSP 24 is directly outputted to the output mixing circuit 25.

The DSP24 has a MIXS register 41 of 16 words as a register for storing the inputted digital low frequency signal data from the PCM circuit 23. The DSP 24 has also an EXTS register 42 of 2 words as a register for storing the inputted digital low frequency signal data from an external tone generator 18. The DSP 24 has still more a MEMS register 43 of 32 words as a register for temporarily storing the data which is read from a ring buffer of the DRAM 13, to process it again by the DSP 24. These registers MIXS 41, EXTS 42, and MEMS 43 are connected to both of a register 45 and a selector 48. The register 45 is a circuit for temporarily storing the coefficient data (modulation data) to input it to a multiplying circuit 49 in synchronization with the timing of the tone signal data to be modulated. The selector 48 is a circuit for selecting the tone signal data to be inputted to the multiplying circuit 49. The combination of the input data to the register 45 and the selector 48 allows the process of the DSP 24 to provide the tone signal data with various sound effects.

Figure 9A:
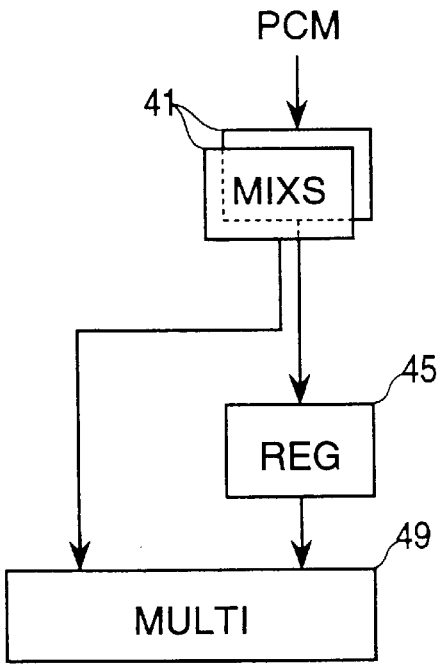
FIGS. 9A and 9B illustrate examples of register configuration in the DSP.
Figure 9B:
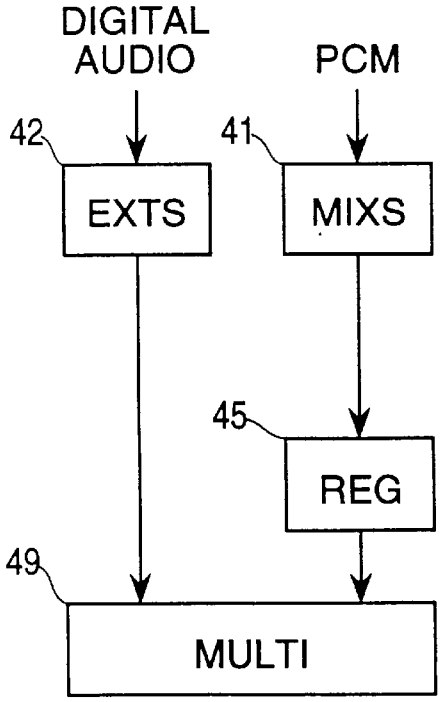

FIGS. 9A and 9B show examples of the combination of the input data to the register 45 and the selector 48. FIG. 9A illustrates a case in which two digital low frequency signal data inputted from the PCM circuit 23 are stored in the MIXS 41, and one data is used as the tone signal data to be modulated, the other data as the modulation data to modulate the tone signal data. FIG. 9B illustrates a case in which one digital low frequency signal data inputted from the PCM circuit 23 is stored in the MIXS 41, and another digital low frequency signal data inputted from the external tone signal generator 18 is stored in the EXTS 42. In this case, the first data stored in the EXTS 42 is used as the tone signal data to be modulated, and the second data stored in the MIXS 41 is used as the modulation data to modulate the first data.

The DSP 24 processes repeatedly the 256 steps of the program stored in a micro program memory 40. The program specifies any desired register, from among the registers, MEMS 43, EXTS 42 and MIXS 41, which outputs the data to the register 45 or the selector 48.

A DRAM address generator 44 generates address data to access the ring buffer in the DRAM 13, and outputs it to the memory controller 21. The memory controller 21 access the DRAM 13 by this address data to write/read data to be delayed in the ring buffer. The multiplying circuit 49, as described above, multiplies the tone signal data by the coefficient data to impart various sound effects to the tone signal data. The tone signal data to be modulated is chosen from among the data of the registers, MIXS 41, EXTS 42, MEMS 43 and a TEMP-RAM 53. The TEMP-RAM 53 is a temporary RAM register to temporarily store the data once processed by this DSP 24, resulting in short delay. The temporarily stored data is inputted for re-processing into the selector 48 or another selector 54 by a feedback circuit. The control of the selectors and any other registers is performed by the program. The coefficient data to be inputted into the multiplying circuit 49 is chosen by a selector 47. The register 45 and a coefficient register 46 in which some fixed coefficient data is stored are connected to the selector 47, and the fixed data "000 . . . 1" (i.e., "1" of decimal numeral) is inputted into the selector 47. The selector 47 chooses onedata from among these data as the coefficient data to be used, and outputs it to the multiplying circuit 49. If the register 45 is chosen, the digital low frequency signal data inputted from the PCM circuit 23 may be imparted, as the modulation data for the sound effects, to the tone signal data inputted from the selector 48. If the coefficient register 46 is chosen in place of the register 45, the modulation to the tone signal data is carried out by the fixed coefficient data stored in the coefficient register 46. If the fixed data, "000 . . . 1", is chosen in place of these registers, the inputted tone signal data is outputted to the next circuit (an adder 50) as it is.

The tone signal data outputted from the multiplying circuit 49 is inputted into the adder 50. The adder 50 adds the specified coefficient data for adding to the tone signal data, the added data being outputted from this DSP 24 through a 1 clock delay circuit 51 and a shift circuit 52. The specified coefficient data for adding is chosen by the selector 54 from among the output of the 1 clock delay circuit 51, the output of the TEMP-RAM 53, and the fixed all "0" data. The 1 clock delay circuit 51 is a circuit for delaying the added data for one sampling clock, and the shift circuit 52 is for shifting thus delayed data by a number of specified figures which is set externally. The TEMP-RAM 53 delays for a moment the output data of the shift circuit 52 by temporarily storing the data. As to the delay of data, the ring buffer's one (from 10 ms to 1 s) in the DRAM 13 is longer than the TEMP-RAM's one.

In the DSP 24, various sound effects can be imparted to the tone signal data by the delay of the ring buffer, the 1 bit delay circuit 51, and the TEMP-RAM 53, by the multiplying of the multiplying circuit 49, and by the adding of the adder 50. Furthermore, it is optional to select the input data to the multiplying circuit 49, as the tone signal data, from among the digital low frequency signal data, the digital signal data from the external tone signal generator 18, and the delayed digital signal data outputted from the ring buffer in the DRAM 13. Also, it is arbitrary to select the coefficient data for multiplying from among the digital low frequency signal data, the digital signal data from the external tone signal generator 18, the delayed digital signal data outputted from the ring buffer in the DRAM 13, and the fixed coefficient data from the coefficient register 46. This configuration of the DSP 24 allows the sound effects to be much wider, deeper, and more optional.

In the embodiment of the present invention, various kinds of signal data, for filtering or modulating to the digital low frequency signal data, can be generated.

Figure 10:
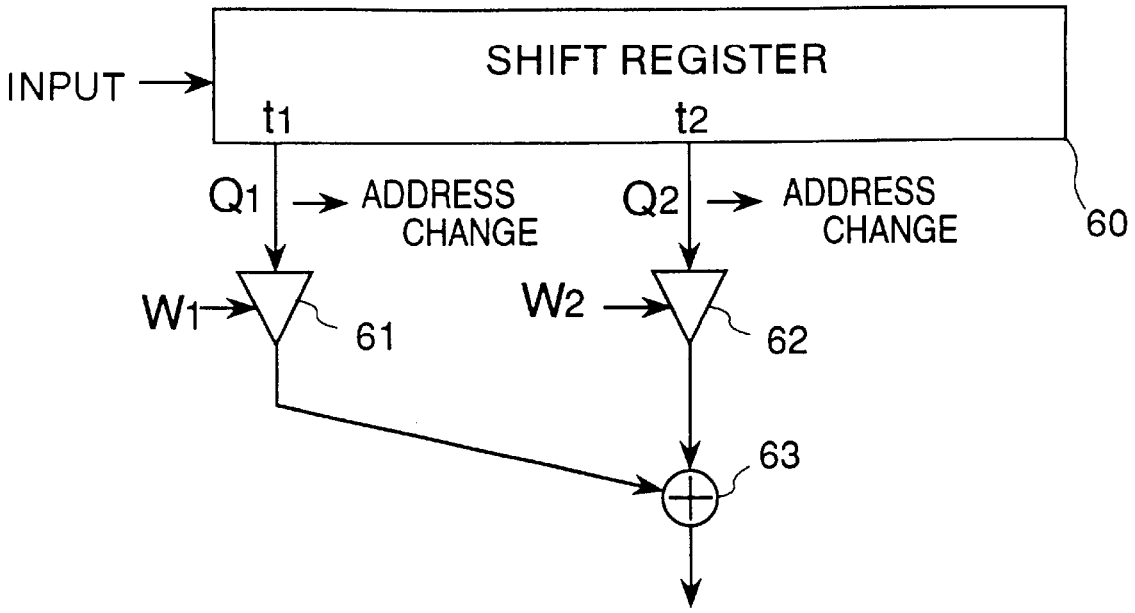
FIG. 10 shows schematic constitution of the DSP for pitch changing.
Figure 11:
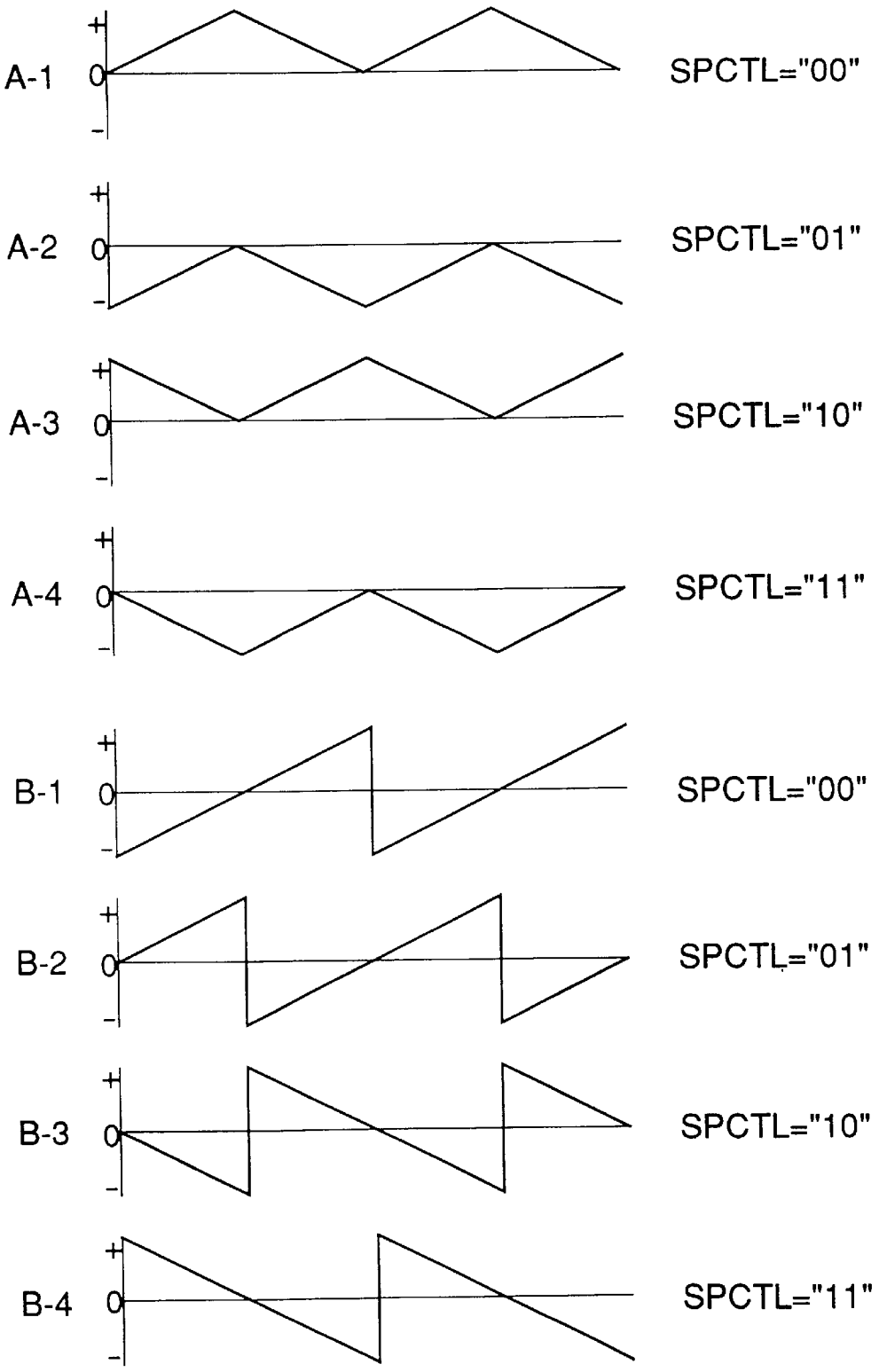
FIG. 11 shows examples of signal data for the pitch changing.

FIG. 10 shows an equivalent circuit of the DSP 24 in pitch-change process, which is an example of the modulating, to the digital low frequency signal data to be inputted. FIG. 11 illustrates examples of modulation signal data for the pitch-change process.

In FIG. 10, a shift register 60 is replaced with the ring buffer for making easy understanding. The tone signal data, such as the digital low frequency signal data, is inputted into the shift register 60 from one side of it. The inputted tone signal data, which is shifted in the shift register 60, is read at two taps t1 and t2. At the tap t1, a coefficient multiplying circuit 61 is connected, coefficient data W1 being multiplied by the read tone signal data Q1, and at the tap t2, another coefficient multiplying circuit 62 is connected, output data of the multiplying circuits 61 and 62 being added at an adder 63 for outputting.

In the above mentioned arrangement, as each of the read addresses of the tap t1 and t2 is shifted back gradually, the frequency of the tone signal data to be read is lower, while as each of the read addresses of the tap t1 and t2 is shifted ahead gradually, the frequency of the tone signal to be read is higher. However, the number of stages of the shift register 60 (i.e., the ring buffer) is limited, and therefore, the shifting back or ahead is limited. To solve the problem, when the read address reaches the end address, the read address is jumped to the opposite end, that is, the address is changed to the start address. The address increases as a saw tooth pulse shown in B-1 to B-4 of FIG. 11.

The first saw tooth pulse B-1 is used for shifting back the read address of the tap t1, and when the read address reaches the end address, the read address is changed to the start address. The second saw tooth pulse B-2 is used for shifting back the read address of the tap t2, and when the read address reaches the end address, the read address is changed to the start address.

There is a problem in the saw tooth pulses. Namely, when the read address is jumped from the end address to the start address, the output (read) tone signal data becomes discontinuity, thereby generating noises. Therefore, in this embodiment, the amplitude value of the read tone signal data which is read at the tap t1 is multiplied by a triangle wave pulse, as coefficient data, shown in A-1 of FIG. 11. As a result, when the address is jumped, the value of the output (read) tone signal data becomes "0" so as to no noise is generated. Also, the amplitude value of the read tone signal data which is read at the tap t2 is multiplied by another triangle pulse, as coefficient data, shown in A-3 of FIG. 11. There is a phrase difference of 180 degrees between the saw tooth pulses B-1 and B-2, and between the triangle pulses A-1 and A-3, so that when the read address at one tap is jumped to the start address and the output tone signal data becomes "0", the output tone signal data at the other tap becomes maximum value, and therefore, the tone signal data outputted from the adder 63 keeps constant value.

The above-mentioned case relates to that the frequency of the output tone signal data changes gradually lower value. On the contrary, when the frequency of the output tone signal data changes gradually higher value, the read addresses at the taps t1 and t2 are changed gradually by the saw tooth pulses B-3 and B-4. In the case of that the shift register 60 is used equivalently, a movement direction of the taps corresponds to the pitch up anddown of the tone signal data. While, in the case of that the ring buffer is used in place of the shift register, the difference between the change speeds of the write address and the read address corresponds to the pitch up and down of the tone signal data.

If the DSP 24 is arranged as shown in FIG. 10 to perform the pitch change of the tone signal data, the triangle pulses shown in A-1 to A-4 of FIG. 11 and the saw tooth pulses shown in B-1 to B-4 of FIG. 11 are inputted, as the modulation signal data, from the PCM circuit 23. In order to generate the modulation signal data, only one set of the triangle pulse and the saw tooth pulse is stored in the DRAM 13, and the sign part and/or the amplitude value part of the tone signal data can be inverted by the inverter 34, therefore all kinds of the triangle and the saw tooth pulses being generated. In the DSP, the saw tooth pulse is inputted into the DRAM address generator 44 at a specified timing, the triangle pulse is inputted into the multiplying circuit 49 at a specified timing.

As mentioned above, the tone signal data, such as the saw tooth pulse and the triangle pulse, including in the PCM wave data is inverted by the inverter 34, therefore generating various kinds of the signal data. As a result, the DRAM's capacity decreases.

The inverting of the inverter 34 is applicable to the tone signal data as well as the modulation signal data.

Figure 12:
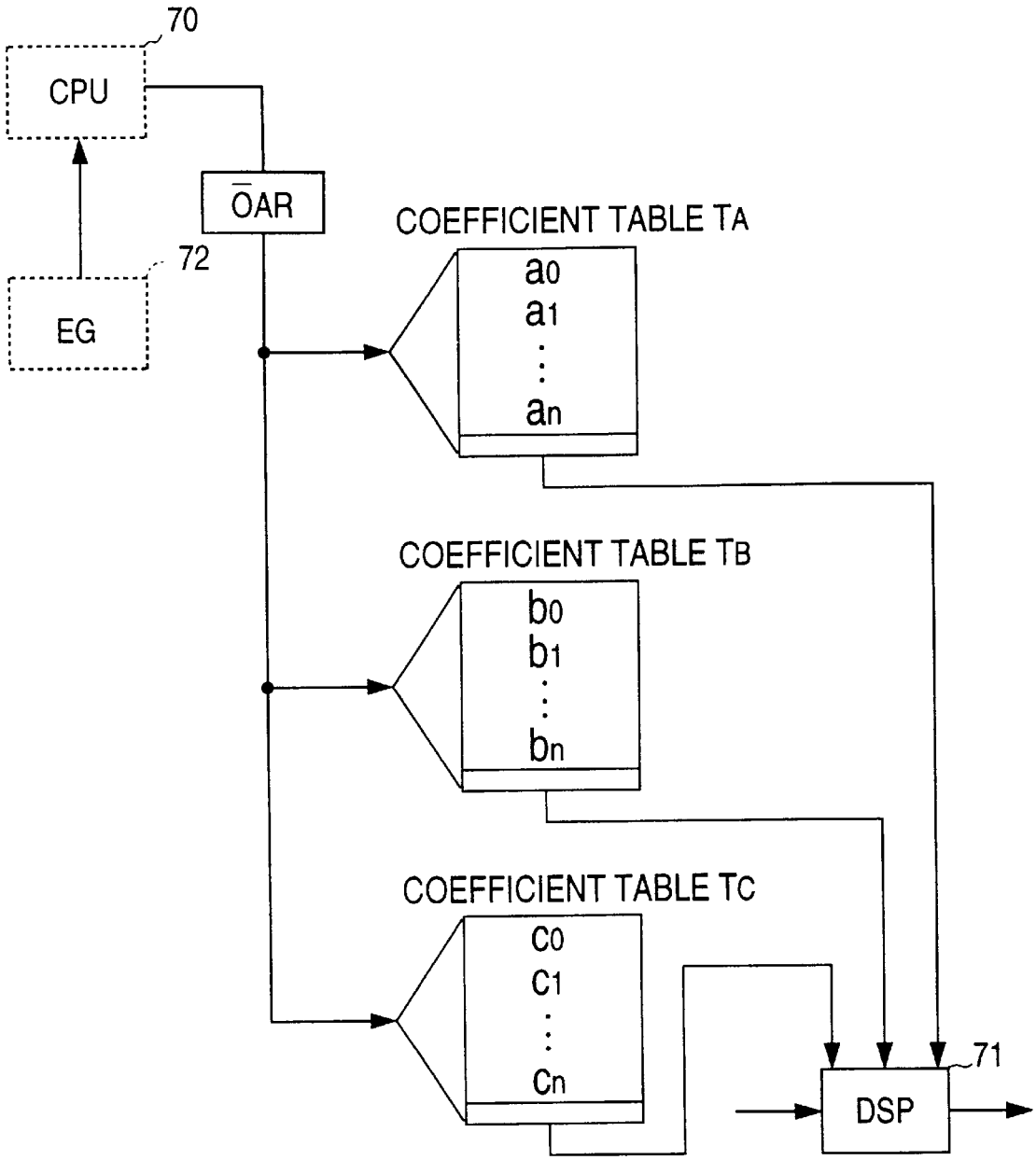
FIG. 12 shows a filter device arranged in the tone signal generator LSI.

In order to provide the wider sound effects to the digital low frequency signal data by selecting dynamically the coefficient group for filtering from the coefficient groups stored beforehand, a device for filtering is constituted as shown in FIG. 12.

Figure 18:
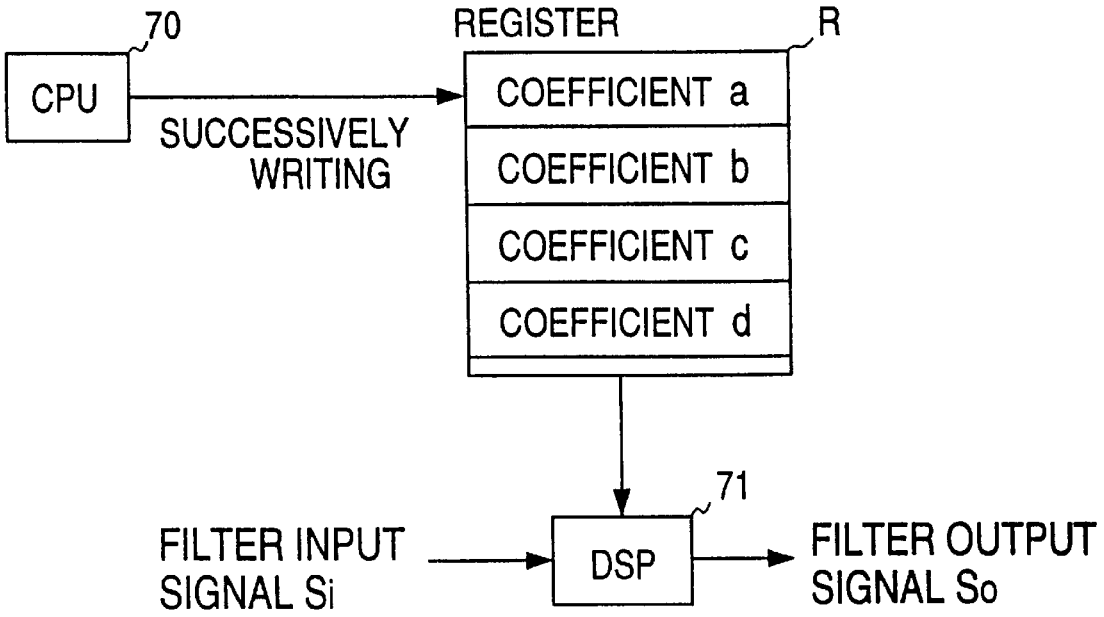
FIG.18 PRIOR ART
FIG. 18 shows a filter device in prior tone signal generator LSI.

The difference between the prior art shown in FIG. 18 and the device is that a plurality of coefficient tables TA, TB, . . . TC and an offset address register (OAR) to decide which coefficients are used are provided. The CPU 70 uses the OAR to select the coefficient in each table. The coefficient in each table is selected by use of the address in the OAR, and then all the coefficients stored in each table are supplied to the DSP 71 at the same time. Each coefficient table is connected to each coefficient input terminal of the DSP 71. Therefore, when one address data is selected and set into the OAR by the CPU 70, the filter coefficients in each coefficient table are supplied to the DSP 71 at the same time.

The address data in the OAR can be changed by the CPU 70. That is, if a filtering way to the input signal is changed, the OAR data is changed by the CPU 70. When the OAR data is changed, the coefficients group supplied to the DSP 71 is immediately changed, so that coefficient conflicts don't occur.

In FIG. 12, for example, when the OAR data is set to "0" by the CPU 70, the coefficients corresponding to the OAR= "0" in the tables are supplied to the DSP 71. The DSP 71 performs the filtering process, i.e., the multiplying and the adding between the input tone signal data and the coefficients. If the OAR data is changed to the "1" by the CPU 70, the DSP 71 changes immediately the coefficient group for filtering from the group corresponding to OAR="0" to another group corresponding to OAR="1".

The above process can be applied to filter EG generating. That is, the CPU 70 watches the EG data generated by the EG data generator 72, and changes the OAR data according to the level of the watched EG data. In this case, an independent circuit for changing the EG level to the OAR data can be used in place of the CPU 70.

Figure 13:
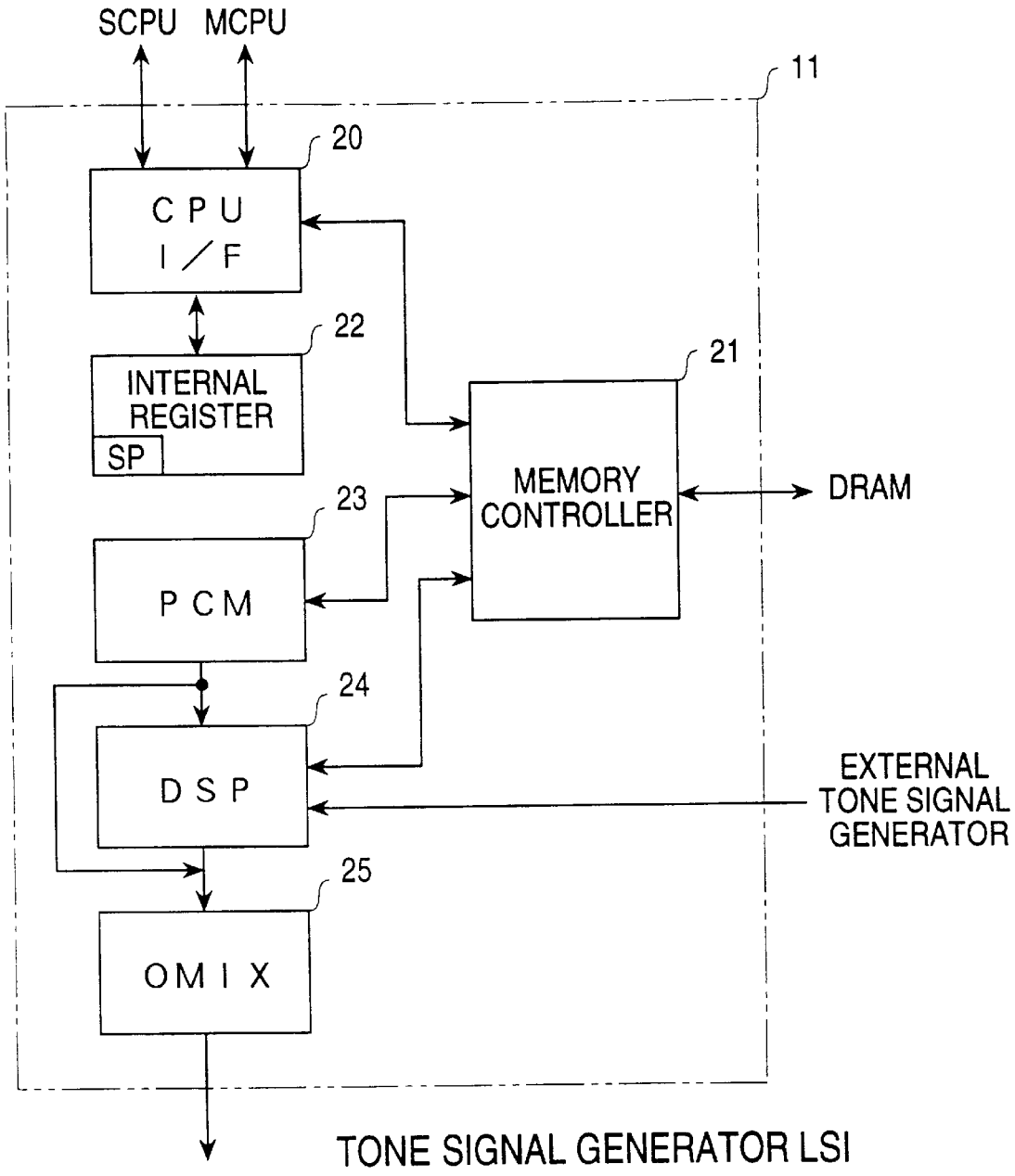
FIG. 13 is a block diagram of the PCM circuit including a SP register.
Figure 14:
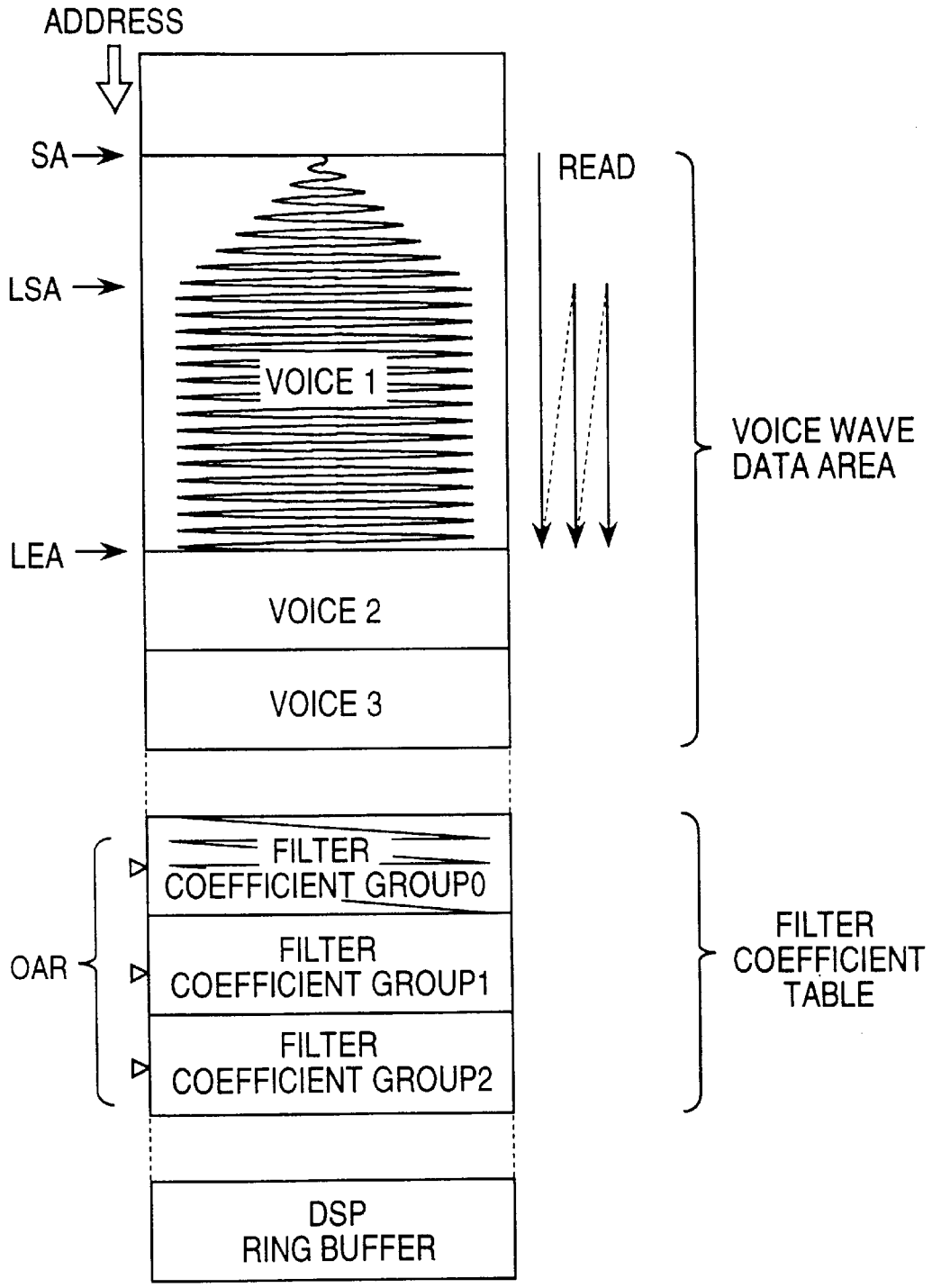
FIG. 14 shows an internal configuration of the DRAM connected to the tone signal generator LSI having the filter device.

In the example shown in FIG. 13, the above coefficient table can be arranged into the internal register 22 of the tone signal generator LSI 11. A register SP assigned in the register 22 is corresponding to the offset address register OAR shown in FIG. 12, providing the offset addresses of every filter coefficient table which supplies the coefficients to the DSP 24. As shown in FIG. 14, the filter coefficient tables are constituted in the DRAM 13 for each table, and the offset address in each filter table can be specified by the register SP in the internal register 22. The specifying of the offset address is performed by the SCPU 12 which sets the offset address into the register SP of the tone signal generator LSI 11. The set data in the register SP can be changed by the SCPU according to the output data of the EG 36.

Figure 15:
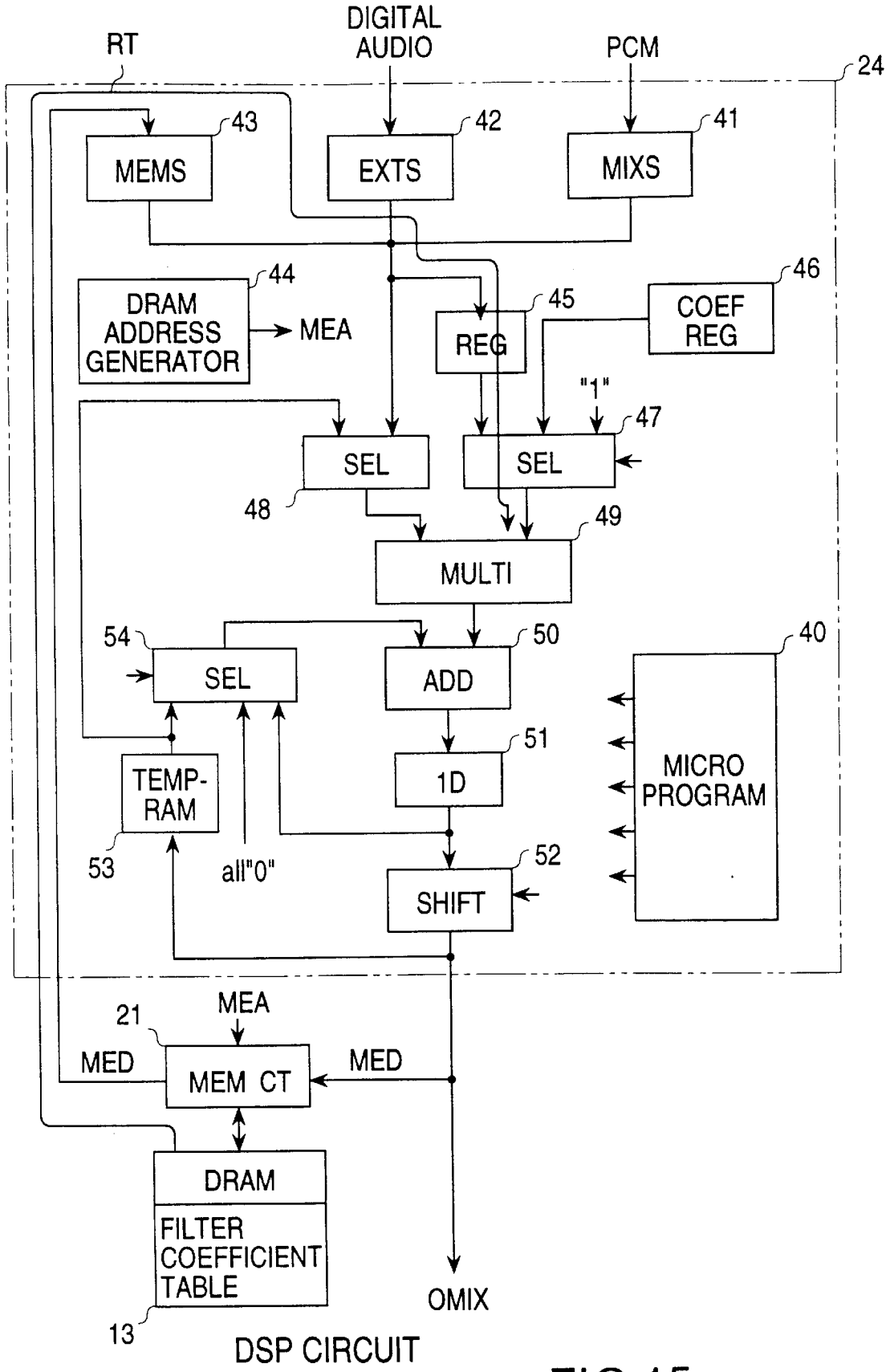
FIG. 15 is a block diagram of the DSP arranged in the tone signal generator LSI having the filter device.

In order to perform the dynamic filtering by the DSP, the filter coefficients for filtering are supplied from the filter coefficient tables in the DRAM 13 through the register 45 in the DSP 24. Therefore, the filter coefficients stored in the filter coefficient tables of the DRAM 13 supplied to the multiplying circuit 49 through a signal root RT shown in FIG. 15, and then the specifying of the filter coefficients is performed by the SCPU 12 which sets the offset address into the register SP of the internal register 22. The setting the offset address into the register SP allows the memory controller 21 to read the filter coefficients each of which corresponds to the address of the register SP, and thereby the thus read filter coefficients are supplied immediately to the multiplying circuit 49 in the DSP 24. If the filter coefficients should be changed, the address data of the register SP is changed to new address data which is corresponding to the filter coefficients. After that, the changed filter coefficients are used immediately.

As described above, the change of the filter coefficients is immediately possible by changing the set data of the register SP. As a result, the immediate change of the filter coefficients allows the dynamic filtering to be easy, causing no conflicts in filtering.

The output data of the EG 36 can be used for the dynamic filtering. That is, the SCPU 12 watches the output data of the EG 36, and changes the address set in the register SP according to the level of the EG data. The filter EG is performed by such process.

Figure 16:
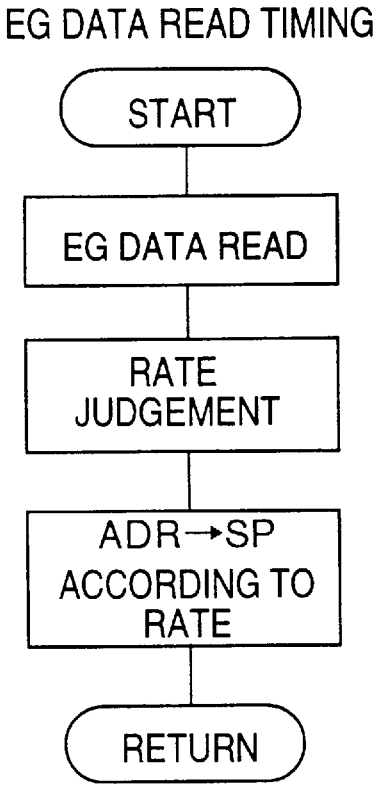
FIG. 16 is a flow chart showing a process for EG data reading.

FIG. 16 is a flow chart showing a process of the SCPU 12 to obtain the filter EG data. When the read timing of the EG data comes by an interruption of a timer or the like, the output data, i.e., EG data, of the EG 36 is read, and which position (rate) in FIG. 8 the read output data corresponds to is judged. The judgement of the rate can be performed by the level difference between the EG data read before and the EG data read presently. After the judgement of the rate, the address corresponding to the rate, i.e., the offset address, to which the filter coefficients for filtering to the tone signal corresponding to the rate are stored, is set into the register SP. It is possible to constitute an individual circuit in place of the CPU process above mentioned, for example, a table, for converting the EG level data into the offset address data to be stored in the register SP.

Figure 17:
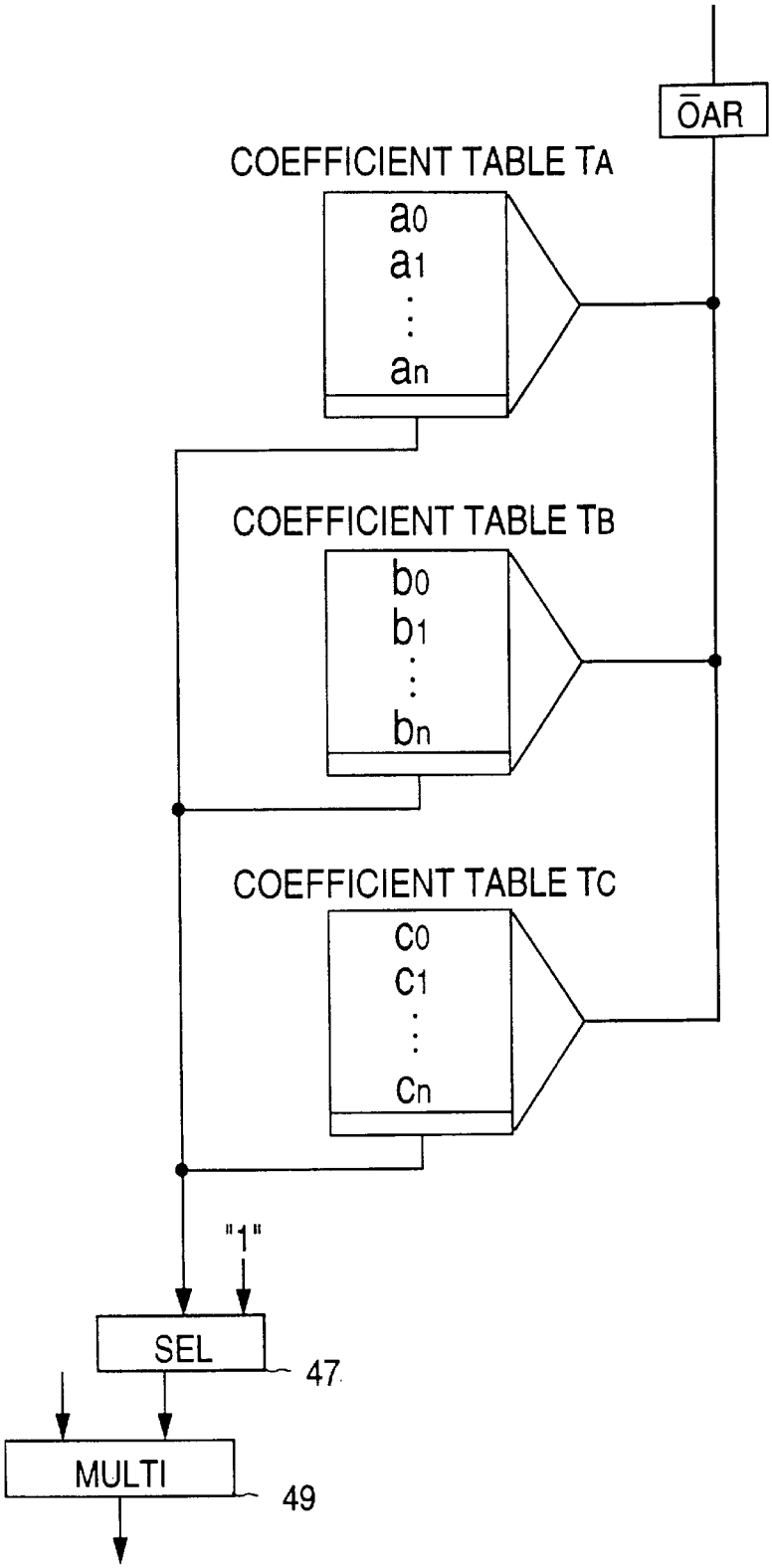
FIG. 17 shows another example of the filter device.

FIG. 17 shows another example of the device for filtering. In this device, the filter coefficient tables are constituted in the internal RAM of the DSP 24.

What is claimed is:

1. A tone signal generator comprising:

an addressable memory for storing data representative of a waveshape of a first musical instrument tone and data representative of a waveshape of a second musical instrument tone;

a circuit for generating a first signal and a second signal by retrieving said waveshape data from the memory, said first signal being based upon data representative of the first musical instrument tone retrieved from the memory at a first memory location at a rate suited for tone generation and said second signal being based upon data representative of the second musical instrument tone retrieved from the memory at a second memory location at a rate suited for generating wave modification data; and a circuit for modifying the first signal based upon the second signal to provide a tone signal, wherein the first signal is a voice signal and the second signal is a modulation signal, and wherein the circuit for modifying modulates the voice signal with the modulation signal to provide the tone signal.

2. The tone signal generator of claim 1, wherein the first signal includes digital samples of a waveform and the second signal includes digital samples of a modulation signal, and wherein the circuit for modifying multiplies at least some of the digital samples of the first signal by digital samples of the second signal to provide a digital tone signal.

3. The tone signal generator of claim 2, the tone signal generator further comprising a circuit for converting the digital tone signal into an analog tone signal.

4. The tone signal generator of claim 2, wherein the modulation signal is representative of a signal envelope and the modifying circuit imparts the signal envelope to the waveform samples to provide the digital tone signal.

5. The tone signal generator of claim 3, wherein the modulation signal is representative of the output of an oscillator and the modifying circuit imparts an amplitude modulation effect to the waveform to provide the digital tone signal.

6. A method of generating a tone signal, the method comprising:

generating a first signal based upon data representative of a waveshape of a first musical instrument tone retrieved from a memory at a rate suited for tone generation;

generating a second signal based upon data representative of a waveshape of a second musical instrument tone retrieved from the memory at a rate suited for generating wave modification data; and modifying the first signal based upon the second signal to provide the tone signal wherein the first signal is a voice signal and the second signal is a modulation signal, and the modifying step includes modulating the voice signal with the modulation signal to provide the tone signal.

7. The method of claim 6, wherein the first signal includes digital samples of a waveform and the second signal includes digital samples of a modulation signal, and wherein the modifying step includes multiplying at least some of the digital samples of the first signal by digital samples of the second signal to provide a digital tone signal.

8. The method of claim 7, the method further comprising converting the digital tone signal into an analog tone signal.

9. The method of claim 7, wherein modulation signal is representative of a signal envelope and the modifying step further includes imparting the signal envelope to the waveform samples to provide the digital tone signal.

10. The method of claim 7, wherein the modulation signal is representative of the output of an oscillator and the modifying step further includes imparting an amplitude modulation effect to the waveform to provide the digital tone signal.

11. A tone signal generator comprising:

an addressable memory for storing data representative of a waveshape of a musical instrument tone;

a circuit for generating a first signal and a second signal by retrieving said waveshape data from the memory, said first signal being based upon data retrieved from the memory at a rate suited for tone generation at first memory retrieval intervals and said second signal being based upon data retrieved from the memory at a rate suited for generating wave modification data at second memory retrieval intervals which are time multiplexed with the first memory retrieval intervals; and a circuit for modifying the first signal based upon the second signal to provide a tone signal, wherein the first signal is a voice signal and the second signal is a modulation signal, and wherein the circuit for modifying modulates the voice signal with the modulation signal to provide the tone signal.

12. The tone signal generator of claim 11, wherein the first signal includes digital samples of a waveform and the second signal includes digital samples of a modulation signal, and wherein the circuit for modifying multiplies at least some of the digital samples of the first signal by digital samples of the second signal to provide a digital tone signal.

13. The tone signal generator of claim 12, the tone signal generator further comprising a circuit for converting the digital tone signal into an analog tone signal.

14. The tone signal generator of claim 11, wherein the rate suited for tone generation is substantially higher than the rate for generating wave modification data.

15. The tone signal generator of claim 13, wherein the modulation signal is representative of the output of an oscillator and the modifying circuit imparts an amplitude modulation effect to the waveform to provide the digital tone signal.

16. A method of generating a tone signal, the method comprising:

generating a first signal based upon data representative of a waveshape of a musical instrument tone retrieved from a memory at a rate suited for tone generation at first memory retrieval intervals;

generating a second signal based upon the waveshape data retrieved from the memory at a rate suited for generating wave modification data at second memory retrieval intervals which are time multiplexed with the first memory retrieval intervals; and modifying the first signal based upon the second signal to provide the tone signal, wherein the first signal is a voice signal and the second signal is a modulation signal, and the modifying step includes modulating the voice signal with the modulation signal to provide the tone signal.

17. The method of claim 16, wherein the first signal includes digital samples of a waveform and the second signal includes digital samples of a modulation signal, and wherein the modifying step includes multiplying at least some of the digital samples of the first signal by digital samples of the second signal to provide a digital tone signal.

18. The method of claim 17, the method further comprising converting the digital tone signal into an analog tone signal.

* * * * *